US010765574B2

(12) United States Patent
Srinivasan et al.

(10) Patent No.: US 10,765,574 B2
(45) Date of Patent: Sep. 8, 2020

(54) EASY TO USE PORTABLE MANUAL STANDING WHEELCHAIR WITH SAFETY FEATURES AND FOR OUTDOOR USE

(71) Applicant: INDIAN INSTITUTE OF TECHNOLOGY MADRAS (IIT MADRAS), Chennai (IN)

(72) Inventors: Sujatha Srinivasan, Chennai (IN); Vivek Sarda, Chennai (IN); Sourav Swostik Dash, Chennai (IN)

(73) Assignee: INDIAN INSTITUTE OF TECHNOLOGY MADRAS (IIT MADRAS), Chennai (IN)

( * ) Notice: Subject to any disclaimer, the term of this patent is extended or adjusted under 35 U.S.C. 154(b) by 0 days.

(21) Appl. No.: 16/337,756

(22) PCT Filed: May 15, 2018

(86) PCT No.: PCT/IN2018/050305

§ 371 (c)(1),
(2) Date: Mar. 29, 2019

(87) PCT Pub. No.: WO2018/220641

PCT Pub. Date: Dec. 6, 2018

(65) Prior Publication Data

US 2020/0078237 A1 Mar. 12, 2020

(30) Foreign Application Priority Data

May 31, 2017 (IN) ..... 201741019125

(51) Int. Cl.

| | |
|---|---|
| ***A61G 5/14*** | (2006.01) |
| ***A61G 5/12*** | (2006.01) |
| ***A61G 5/02*** | (2006.01) |

(52) U.S. Cl.
CPC ..... *A61G 5/14* (2013.01); *A61G 5/02* (2013.01); *A61G 5/125* (2016.11)

(58) Field of Classification Search
CPC ..... A61G 5/00; A61G 5/023; A61G 5/026
See application file for complete search history.

(56) References Cited

U.S. PATENT DOCUMENTS

| | | | | |
|---|---|---|---|---|
| 5,727,809 | A * | 3/1998 | Ordelman | A61G 5/027 280/250.1 |
| 7,419,176 | B2 * | 9/2008 | Perk | A61G 5/14 280/250.1 |
| 9,044,369 | B2 * | 6/2015 | Goldish | A61G 5/14 |
| 9,101,520 | B2 * | 8/2015 | Goldish | A61G 5/14 |
| 9,173,792 | B2 * | 11/2015 | Goffer | A61G 5/12 |
| 9,737,448 | B2 * | 8/2017 | Farmer | A61G 5/1059 |
| 10,130,535 | B2 * | 11/2018 | Purwar | A61G 7/1046 |
| 10,548,792 | B2 * | 2/2020 | Cheek | A61G 5/10 |
| 2016/0302984 | A1 | 10/2016 | Hunziker | |

FOREIGN PATENT DOCUMENTS

| | | |
|---|---|---|
| EP | 0231718 B1 | 8/1991 |
| EP | 2127625 A1 | 12/2009 |

* cited by examiner

*Primary Examiner* — John D Walters
*Assistant Examiner* — James J Triggs
(74) *Attorney, Agent, or Firm* — Seyfarth Shaw LLP; Brian Michaelis

(57) ABSTRACT

The invention is for a standing 3 wheeled wheelchair with a pivoted seat having link means, a dyad means, removable side handle actuator means, a lockable knee support with interlocking cam means, which enables the user to stand effortlessly and safely in the wheel chair.

6 Claims, 7 Drawing Sheets

Step 1

Step 2

Step 3

Figure 1:
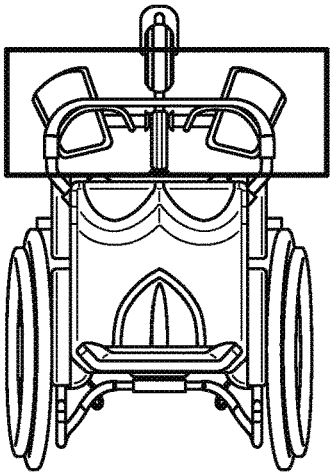
Figure 1A:
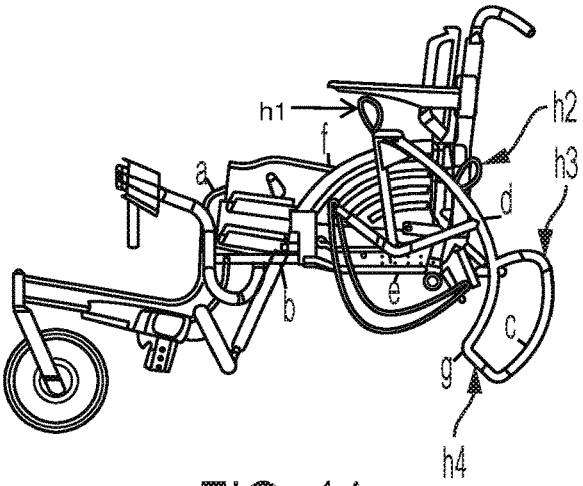

EASY TO USE PORTABLE MANUAL STANDING WHEELCHAIR WITH SAFETY FEATURES AND FOR OUTDOOR USE

FIELD OF INVENTION

The invention is in the field of improving quality of life of wheelchair users. In specific, the invention incorporates a mechanism which could allow the user to get into standing position easily and independently. Standing for people with disability like Spinal Cord Injury (SCI) provides various psychological and health benefits. The wheelchair is designed in a manner to be suitable for outdoor use as well.

SUMMARY AND BACKGROUND LEADING TO THE INVENTION

Generally People with disability like SCI use wheelchair for most parts of the day. These people do not have any muscle control below the level of injury which limits them from standing independently. It has been documented that standing provides various health and psychological benefits. In India, many people with disability live in rural areas where the terrain is uneven, affordability, portability and maintenance is also a concern. To maximize the benefits of standing, a manual standing mechanism has been incorporated into the wheelchair which could enable the user to get into standing position easily and independently. A support system is essential at the knee of the user to safely get them into the standing position. Getting into the standing position without the knee support could be potentially harmful. A safety mechanism has been incorporated to ensure that the standing mechanism cannot be activated without the knee support being in place. Another safety lock apart from knee support lock, has been designed to improve the safety of the device. The wheelchair is designed to work well on uneven surfaces. The manual configuration of the wheelchair and the standup mechanism ensures the ease of maintenance and affordability of the solution. The key objective of the design is safe manual standing wheelchair for outdoor use.

Some of the known prior art to the inventions are:

U.S. Ser. No. 09/946,455—Provides a body support system to ensure safety of the user in the standing position. While a harness for the user is also provided in our current design, the current work relates to ensuring extra safety by design by disengaging the standing mechanism itself in the attempt to stand without the knee support.

U.S. Ser. No. 06/612,916—Provides a body support system to ensure safety of the user in the standing position. While a harness is typically used to support the body, the current work relates to ensuring extra safety by disengaging the standing mechanism itself should the user make an attempt to stand without the knee support.

EP19970810375—Provides a mechanism to lower the footrest as the user gets into standing position for increased stability. The current design uses a longer base to provide for stability of the wheelchair in the standing position, as well as for ease of outdoor propulsion.

U.S. Pat. No. 4,569,556—Provides a mechanism to take the user into standing position and lower the footrest for stability.

To perform well in outdoor scenario and for extra stability in the standing position without moving the footrest down, the current design uses a longer 3 wheel configuration. This 3-wheel configuration poses other challenges, which have also been addressed in our design. To avoid obstruction with the front castor wheel and to ensure correct standing posture, the footrest is designed to be angled out sideways. A large handle is necessary to reduce the effort required for users with high levels of spinal injury who have very little strength in their upper limbs. In this design, despite the larger size of the handle, it is designed such that it does not interfere with the angled-out legs of the user. The large handle affects the portability of the device, and is hence designed to be removable.

Indian Patent Application No: 4806/CHE/2012 titled 'A Multi-position wheelchair'—This provides a mechanism to take the wheelchair into standing as well as reclining position. The current work designs the standing mechanism for the 3 wheel base configuration with an ergonomic large handle which does not hit the legs of the user, and which is also removable for portability. The current work also includes the design of the safety mechanisms for the standing mechanism.

OBJECTS OF THE INVENTION

The main objective of the design is to develop a safe outdoor manual standing wheelchair.

SUMMARY OF THE INVENTION

The invention relates to a novel design of the manual standing mechanism for outdoor wheelchair and safety of the standing mechanism.

Design of the manual standing mechanism for outdoor wheelchair. It aids the comfortable sitting and standing postures for the disabled wheelchair user.

DESCRIPTION OF THE INVENTION

The design uses a 3 wheel base for ease of use in uneven outdoor rural scenarios in India as shown in FIG. 1. The longer base length between the rear wheels and the front castor, and the large front castor provide stability and ease of maneuverability in uneven terrain. The extra length of the wheelchair compared to regular wheelchairs also provides for extra stability in the standing position. Generally standing wheelchairs need an additional mechanism to get the footrest down as the wheelchair gets into standing position, the need for which is eliminated in this design by having a longer wheelbase. To achieve a straight standing posture, the footrest has been designed to be widened and angled out to avoid obstruction with the front castor wheel. This configuration of the footrest moves the leg of the user outwards into the plane of rotation of the standing handle.

Figure 2:
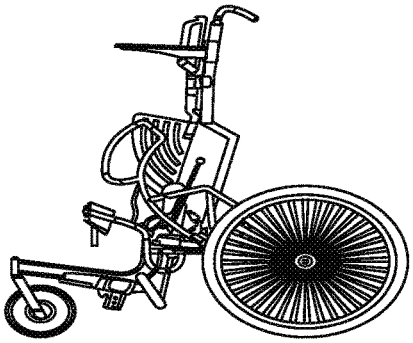
Figure 2A:
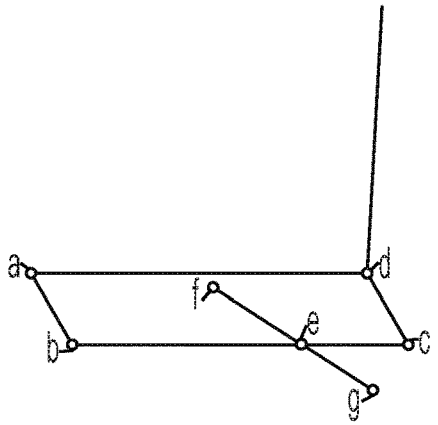

It has been observed that many people with higher levels of injury have limited strength in their upper limbs and reducing the effort required to get into standing position would be beneficial. Hence, the mechanism and standing handle have been designed in a manner to minimize the effort. To reduce the effort required to get into standing position, the large size, shape and configuration of the handle have been designed to provide greater leverage. The push levers for a portion of the handle further enhances the mechanical advantage provided when needed, while the smooth contoured portion provide continuous contact to enhance the feeling of security as the chair is raised to the standing position. Another key feature is that despite the handle being large (to reduce the effort to get into standing position), it is designed such that it does not interfere with the leg of the user as it moves. The large handle has been designed such that it lies in front of the leg of the user in the standing position without interfering with the user as shown in FIG. 2

Figure 3:
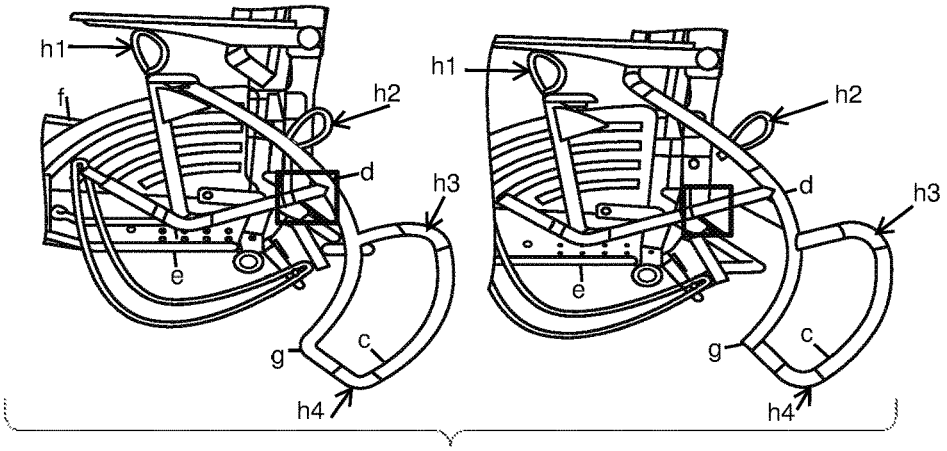

Another important consideration in the design of the wheelchair is portability of the wheelchair. The portability of the current wheelchair is achieved by removing the wheels and folding the backrest down. Another key feature of this design is that the large handle is removable for enhanced portability of the wheelchair. For the removability of the handle a pipe-in-pipe arrangement has been designed with a bolt type frictional lock as shown in FIG. 3. A similar pipe-in-pipe arrangement is used to make the knee block removable for portability.

Safety of the Standing Mechanism

The users have little or no strength in their legs to stand independently. Hence, a support is essential to enable the user to stand, which is provided below the knee. Standing without the use of this support is potentially dangerous to the user. Hence, an extra safety lock mechanism has been incorporated which disables the standing mechanism without the knee support. A cam type arrangement is designed in the knee support receiver on the frame which is activated on placing the knee support. This cam activates a stopper pin via a cable mechanism allowing the standing handle to rotate, thereby enabling the standing mechanism.

Apart from the safety lock at the knee support, an additional lock at the handle has been incorporated to increase safety of the user in case the standing mechanism has been actuated accidentally even when the knee support has been placed. It has been designed such that only actuation of both the side standing handles simultaneously disengages the safety lock and allows the user to get into standing position, thus making the standing a deliberate action on the part of the user.

An alternate mechanism configuration for providing an extra safety lock apart from the one at the knee support is explained below: The armrest is attached to the backrest and has a plate attached such that it forms an obstruction to the rotation of the standing mechanism actuating handle as shown in the FIG. 7. To enable the standing mechanism the armrest has to be moved out and then the standing handle can be actuated. The armrest could be moved upwards, sideways or completely removed. Also, the stopper could be designed as a one way lock which forms an obstruction while getting into standing position but doesn't obstruct during the reverse action of the handle for getting into the sitting position.

DETAILED DESCRIPTION OF DRAWINGS

FIG. 1 Top View of the standing wheelchair in the sitting position—Shows the wide position of the footrest FIG. 1(*a*) Mechanism pivots on the wheelchair (wheel is hidden)

Figure 4:
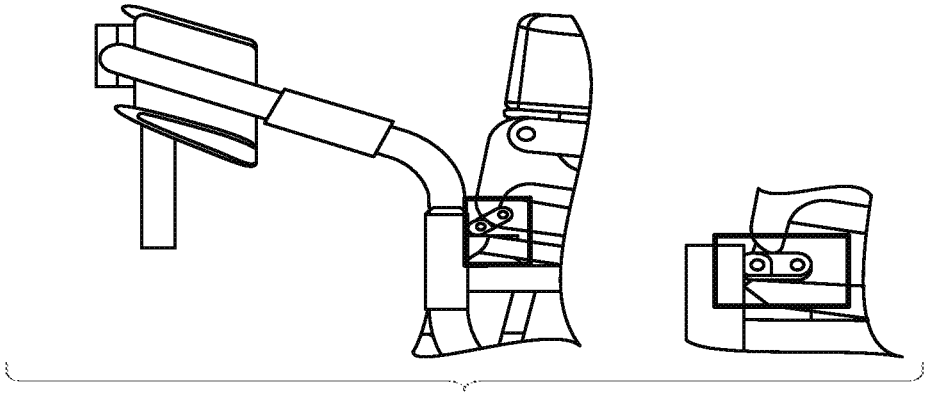
Figure 4A:
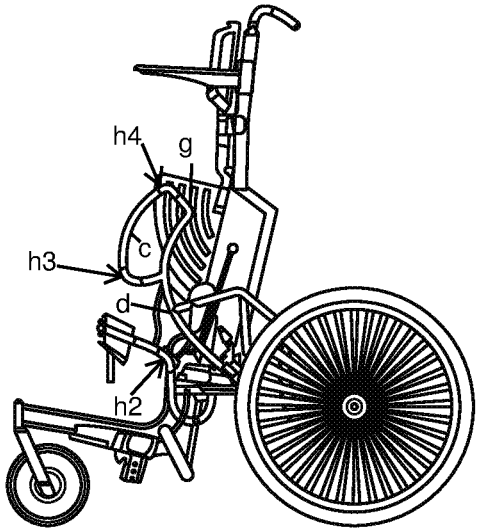
Figure 5:
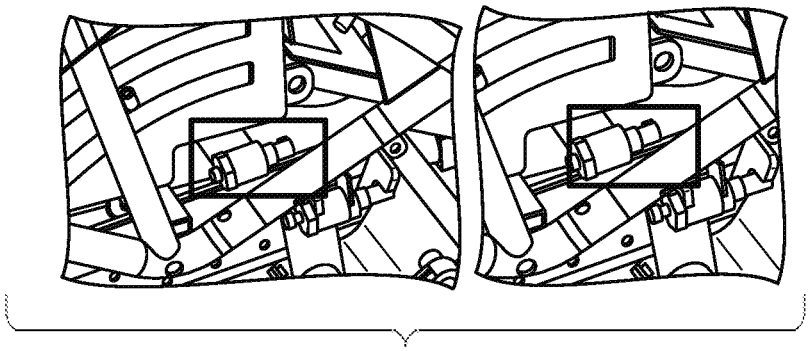
Figure 5A:
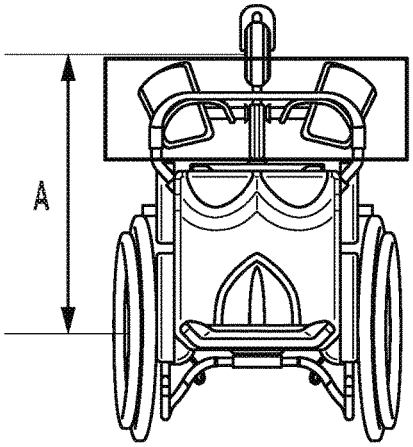
Figure 6:
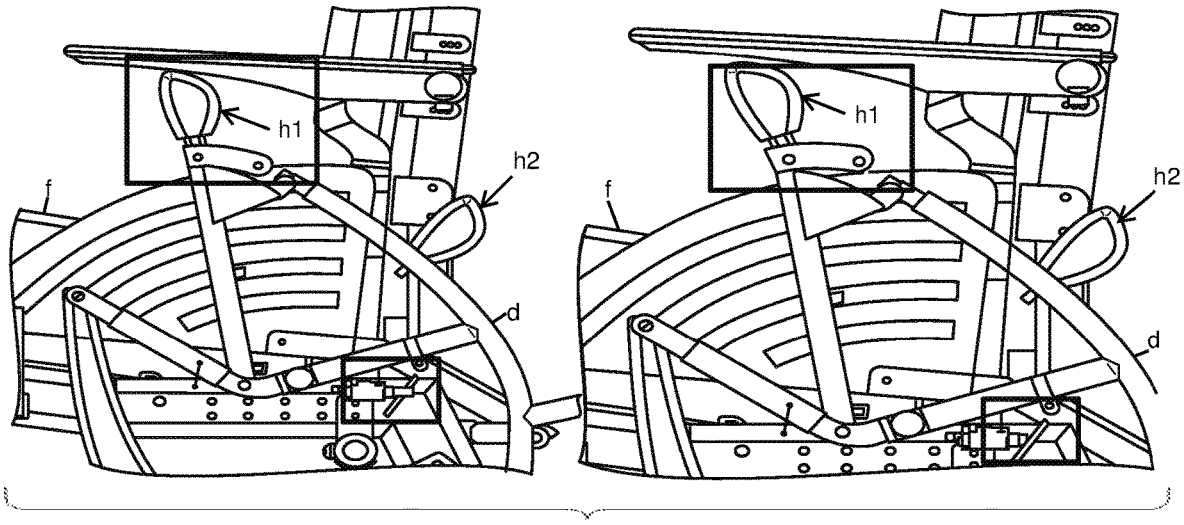
Figure 6A:
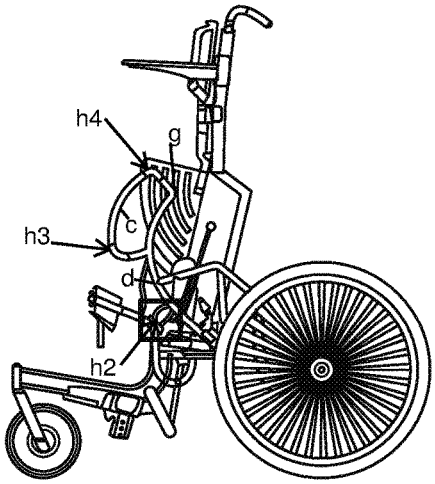
Figure 7:
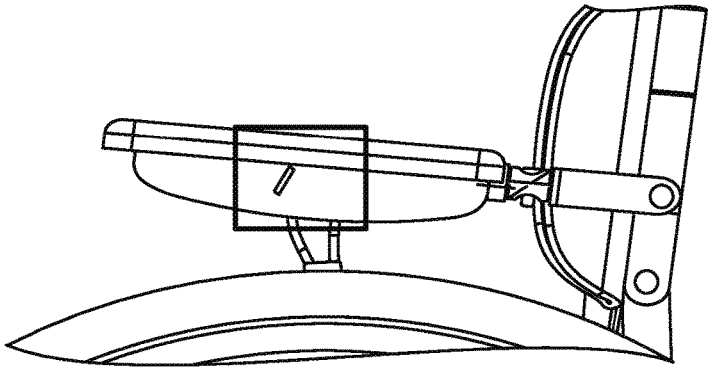
Figure 7A:
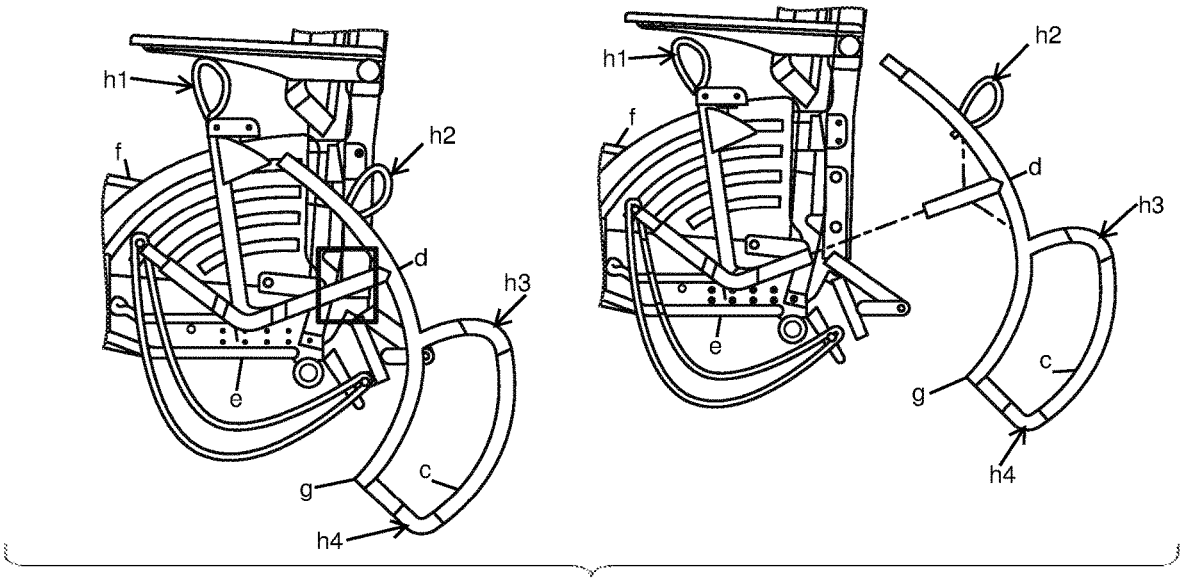
Figure 8:
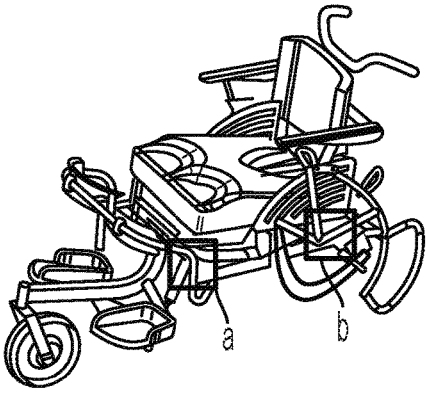
Figure 8A:
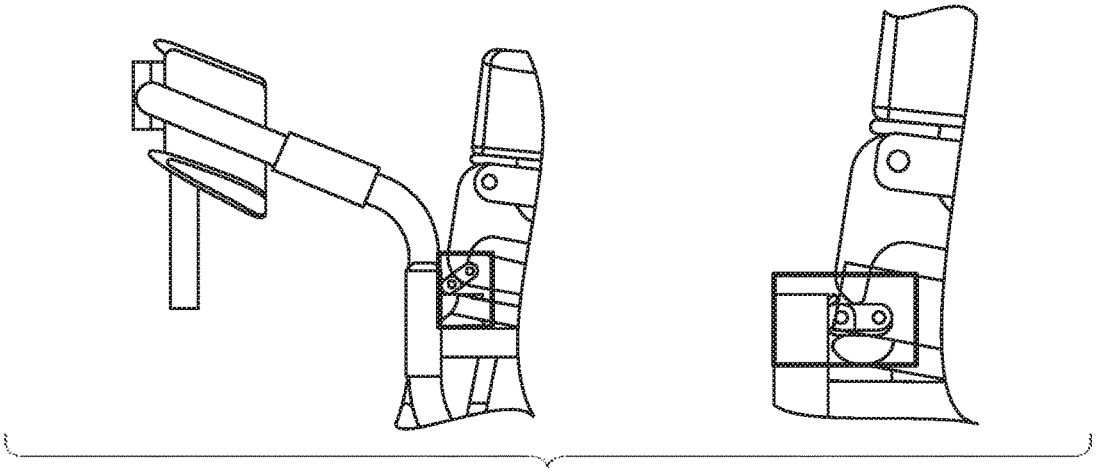
Figure 9:
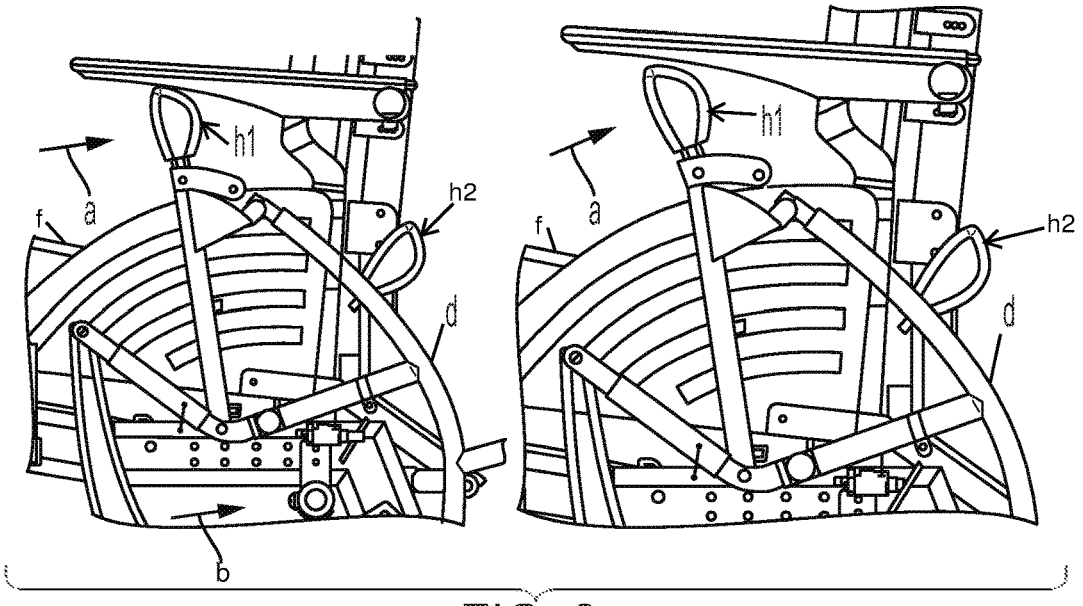

FIG. 2 Side view of the wheelchair in standing position—handle design to not obstruct with the leg of the user FIG. 2(*a*) Layout description of the wheelchair FIG. 3 Demonstrates the handle in removed position FIG. 3(*a*) Mechanism movement as it is actuated into standing position FIG. 4 Figures show the actuation of the knee block cam FIG. 4(*a*) Wheelchair in standing position FIG. 5 Demos the actuation of the pin to enable the standing mechanism FIG. 5(*a*) Top view of the wheelchair showing—(a) Longer wheelbase (b) Footrest position wide and angled out FIG. 6 Actuation of the handle knob powers the pin disengaging the standing lock and enabling the user to get into standing position FIG. 6 (*a*) demonstrates handle in the standing position without interfering with the leg of the user FIG. 7 Demonstrates the stopper on the armrest for the handle FIG. 7 (*a*) Detachment of the handle to improve portability FIG. 8 Mechanism to lock the standing mechanism with the knee support—(a) Knee block CAM (b) Plunger FIG. 8(*a*) Figures show the actuation of the knee block cam by placing the knee support FIG. 8(*b*) Demonstrates the actuation of the pin to enable the standing mechanism FIG. 9 Standing lock at the handle h1—resting position of pin (d) and handle h1 on left side and actuated position of pin and handle h1 on right side. The obstructing plate is marked as (e).

Figure 10:
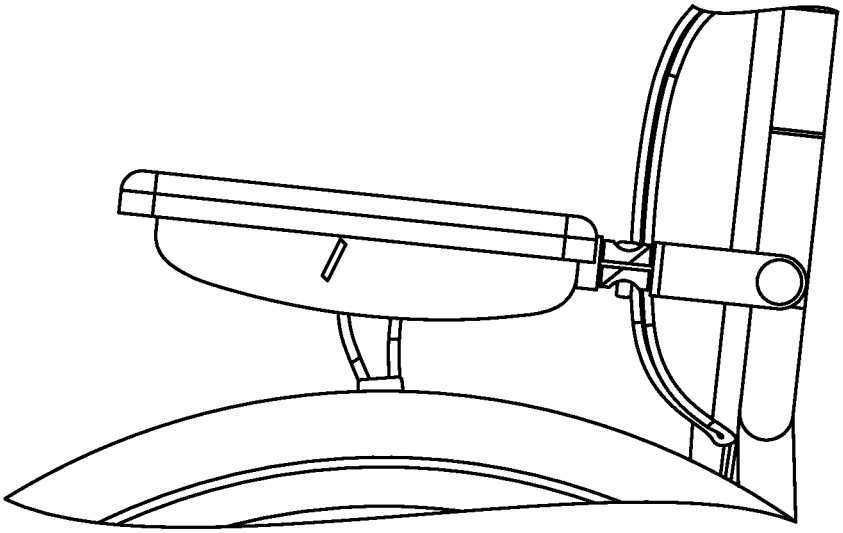

FIG. 10 Demonstrates the stopper on the armrest for the handle

Now the invention is described with respect to drawings for better understanding of the invention The unique feature of the design of the standing mechanism is the design of the handle which provides a large leverage without obstructing with the leg of the user and being removable.

Figure 3A:
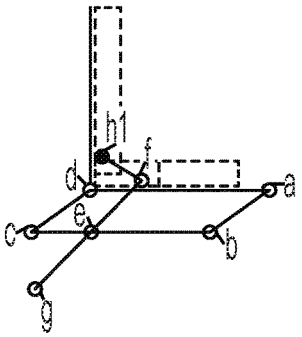
Figure 3B:
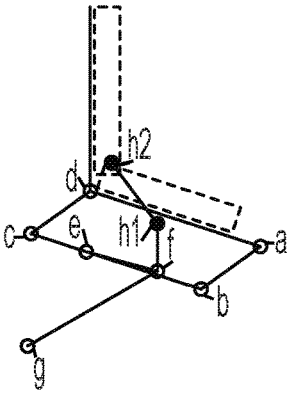
Figure 3C:
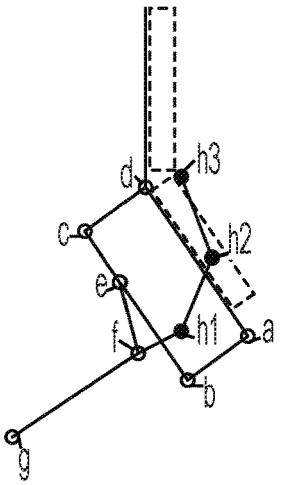

The standing mechanism is designed using a 6-bar (4-bar and driver dyad) linkage mechanism. The pivots of the mechanism in the wheelchair are shown in FIG. 1 (A). Layout of the mechanism is shown in FIG. 2 (A). Link ab,bc,cd,da form the 4-bar mechanism. Link ab is used as the seat of the wheelchair. Backrest is rigidly connected to the link cd. In a particular configuration when length of ad is same as that of bc, this forms a parallelogram mechanism and it ensures that backrest is along the same orientation as the users moves into standing position. Links be, ef, fg and bg form the driver dyad system which actuates the 4 bar mechanism. The mechanism is actuated by the standing handle which is rigidly connected to link ef. Different positions during actuation into standing position shown in FIG. 3(A). As the standing handle is actuated the wheelchair gets into standing position as shown in FIG. 4 (A).

The design uses a 3 wheel base to make the wheelchair more adaptable to outdoor scenario as shown in FIG. 5 (A). As the wheelchair base is longer, no extra mechanism is required to ensure stability in standing position. Many existing standing wheelchair require an extra mechanism which lowers the footrest as the user comes into standing to ensure the stability of the wheelchair. To avoid obstruction between the footrest and the castor wheels, footrest is moved sideways and angled out as shown in FIG. 5 (A). In this position of the footrest, it is often observed that some part of the user's leg, (especially near the knee) is out of the width of the seat and could interfere with the standing mechanism handle. Especially as the users might not have any sensation in the leg, this could be potentially dangerous to the user. The unique feature of this design is the configuration of the mechanism including the standing handle with a greater leverage without obstructing with the leg of the user. This is accomplished by ensuring the handle position near h2 ends before the cushion on the seat as shown in FIG. 6 (A). Larger handle provides a greater leverage reducing the effort required to get into standing position. Larger handle occupies a greater space and causes a restriction in the portability of the wheelchair. The handle has been designed to be removable to improve the portability of the wheelchair. Handle can be removed as shown in the FIG. 7 (A).

Safety of the Standing Mechanism

Figure 8B:
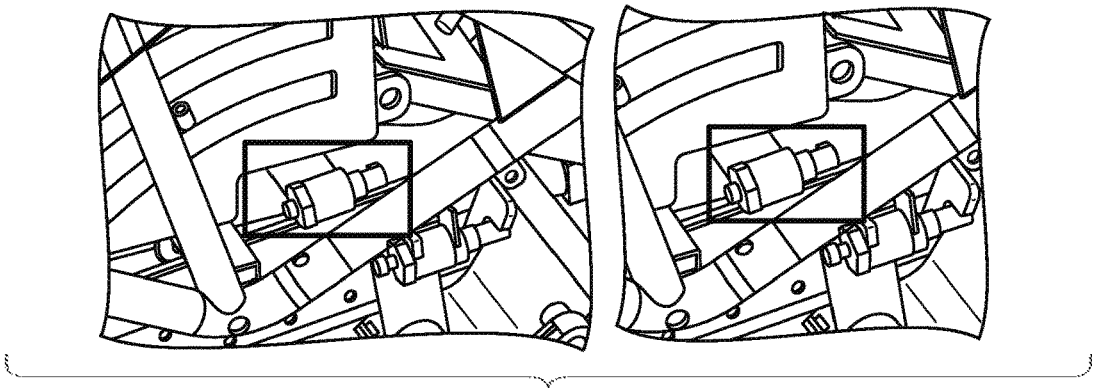

The users have little or no strength in their legs to stand independently. Hence, a support is essential to enable the user to stand, which is provided below the knee. Standing without the use of this support is potentially dangerous to the user. Hence, a unique extra safety lock mechanism has been incorporated which disables the standing mechanism without the knee support. A cam type arrangement is designed in the knee support receiver on the frame which is activated on placing the knee support. When the knee support is not placed, as shown in right side of FIG. 8. (A), the cam remains in the rested position. When the knee support is placed as shown in the left side of FIG. 8(B), the insertion of the knee support pipe presses against the cam and causes it to rotate. This movement of the cam is converted into translation of a pin in a plunger via a cable mechanism. The pin is located such that is causes an obstruction to the rotation of the standing handle when the cam is not actuated as shown in left side of FIG. 8*b*. When the cam is actuated, the movement of pin removes the obstruction from the rotating handle, which disables the standing mechanism lock as shown in right side of FIG. 8*b*. This design of the cam is simple and easy to manufacture. The design is incorporated on both left and right side of the frame. This ensures that only when the knee support is placed properly, both cams get actuated releasing the pin which obstructs the standing handle.

Apart from the safety lock at the knee support, an additional lock at the handle has been incorporated to increase safety of the user in case the standing mechanism has been actuated accidentally even when the knee support has been placed, say by a third person. It has been designed such that only actuation of both the side standing handles h1 simultaneously disengages the safety lock and allows the user to get into standing position as shown in FIG. 9, thus making the standing a deliberate action on the part of the user. A small angle of rotation is provided on the handle h1 by pivoting it to the frame of the handle as shown by 'a' in FIG. 9. When the user pushes this handle h1, the small movement of the handle is used to actuate a pin mechanism via a cable mechanism. The pin mechanism is attached to handle frame and an obstruction plate is attached to the main frame such that direct rotation of the handle causes the pin to obstruct with this plate as shown by 'b' in FIG. 9. When the handle is actuated at h1, first the pin mechanism is actuated which no longer remains an obstruction to the rotation of the handle. By this movement of the handle h1 both sides, the standing lock is deactivated. The pin and obstructing plate are also designed such that when the user comes from standing to sitting position, the pin automatically gets into the locked position. This is accomplished by using the obstructing plate in a slanted manner which allows the pin to slide automatically.

An alternate mechanism configuration for providing an extra safety lock at the standing handle apart from the one at the knee support is explained below: The armrest is attached to the backrest and has a plate attached such that it forms an obstruction to the rotation of the standing mechanism actuating handle as shown in the FIG. 7. To enable the standing mechanism the armrest has to be moved out and then the standing handle can be actuated. The armrest could be moved upwards, sideways or completely removed. Also, the stopper could be designed as a one way lock which forms an obstruction while getting into standing position but doesn't obstruct during the reverse action of the handle for getting into the sitting position.

As described and disclosed above, in one aspect the invention is disclosing a standing wheelchair. It typically has a chassis having a first end and a rear end. A front wheel connected to the front end of the chassis and a pair of rear wheels supporting the wheelchair. A pivotable seat means of a first link (ab), the said seat pivotable between a generally horizontal seated position and an angled standing position, and having a seating surface and a backrest means of a second link (cd), such that (ab), (bc), (cd) and (da) form a four bar parallelogram link means. It includes a driver dyad means comprising of four links (be), (ef), (fg) and (bg) which is adapted to actuate the said 4-bar mechanism. The arrangement has a pair of side handle actuator means, each handle actuator means connected rigidly to link (ef) of the driver dyad means and cooperatively associated with the 4-bar link means for actuating the seat means between the seated position and standing position. For the purpose of safety of the user, a lockable knee support means is attached to the front end of the said seat means moveable between a lock state and open operational state. To ensure the handled is used only when necessary by the user, a pair of side interlocking cam means, each interlocking cam means coupled to the knee support means and the corresponding side handle actuator means for causing the said handle actuator means to move only when the knee support means is in lock state.

In another aspect the standing wheelchair is disclosed above is such that when length of link (ad) is equal to length of link (bc), a parallelogram is formed. This is ideal design for the four link mechanism to operate the wheelchair safely.

In another aspect the standing wheelchair is disclosed above is such that it includes additional interlocking mechanism which is a locking pin, a plunger and a cable means such that the locking pin is selectively extending into and away from the handle actuator means, thereby corresponding to lock state and free operation state of the handle actuator means. The locking pin ensures that there is an intentional operation of the handle mechanism by the user and not an accidental operation.

In another aspect the standing wheelchair has another interlocking means comprising of a moveable armrest and a plate attached to the armrest means which is in turn attached to the backrest means, the said plate arranged in the motion pathway of the handle actuator means, such that the armrest along with the fixed plate extends into and away from the handle actuator means motion pathway, thereby correspondingly creating a lock state and free operate state of the handle actuator means with a locking pin selectively moving towards and away from the plate.

In another aspect the standing wheelchair includes another interlocking means comprising of a stopper means to create a lock state and free operate state of the handle actuator means.

The description is given for the understanding of the invention and thereby the embodiments do not limit the scope of the invention. The variations are within the scope of the invention.

The invention claimed is:

1. A standing wheelchair comprising:

a. a chassis having a first end and a rear end, b. a front wheel connected to the front end of the chassis and a pair of rear wheels supporting the wheelchair, c. a pivotable seat means of a first link (ab), the said seat pivotable between a generally horizontal seated position and an angled standing position, and having a seating surface and a backrest means of a second link (cd), such that (ab), (bc), (cd) and (da) form a four bar parallelogram link means, d. a driver dyad means comprising of four links (be), (ef), (fg) and (bg) which is adapted to actuate the said 4-bar mechanism, e. a pair of removably attached side handle actuator means, each handle actuator means connected rigidly to link (ef) of the driver dyad means and cooperatively associated with the 4-bar link means for actuating the seat means between the seated position and standing position, f. a lockable knee support means attached to the front end of the said seat means moveable between a lock state and open operational state, and g. a pair of side interlocking cam means, each interlocking cam means coupled to the knee support means and the corresponding side handle actuator means for causing the said handle actuator means to move only when the knee support means is in lock state.

2. The standing wheelchair as claimed in claim 1 is such that when length of link (ad) is equal to length of link (bc), a parallelogram is formed.

3. The standing wheelchair as claimed in claim 1 is such that wherein each of the said interlocking cam means includes a locking pin, a plunger and a cable means such that the locking pin is selectively extending into and away from the handle actuator means, correspondingly to free state and lock state of the knee support means, thereby corresponding to lock state and free operation state of the handle actuator means.

4. The standing wheelchair as claimed in claim 1, wherein at least one interlocking cam means is arranged on each side of the wheelchair cooperatively operating with the corresponding side handle actuator means.

5. The standing wheelchair as claimed in claim 1 includes another interlocking means comprising of a moveable armrest and a plate attached to the armrest means which is in turn attached to the backrest means, the said plate arranged in the motion pathway of the handle actuator means, such that the armrest along with the fixed plate extends into and away from the handle actuator means motion pathway on the basis of rotational motion of the handle means, thereby correspondingly creating a lock state and free operate state of the handle actuator means.

6. The standing wheelchair as claimed in claim 1 is such that wherein each of the said actuating handle means includes a locking pin, a plunger and a cable means such that the locking pin is selectively extending into and away from the chassis means by the actuation of the first handle position (h1), correspondingly to lock state and free state of the standing actuating handle means.

* * * * *